United States Patent [19]

Kelley

[11] 3,960,164

[45] June 1, 1976

[54] DEVICE FOR MIXING GASES WITH LIQUIDS

[76] Inventor: Zar W. Kelley, 8438 Broadview Road, Cleveland, Ohio 44141

[22] Filed: May 22, 1974

[21] Appl. No.: 472,218

[52] U.S. Cl. ..... 137/202; 137/411; 137/422; 137/418; 137/209; 261/122; 261/DIG. 7; 222/397

[51] Int. Cl.[2] ..... B67D 5/34

[58] Field of Search ..... 137/418, 422, 411, 202, 137/209; 74/520; 251/75; 261/122, DIG. 7; 222/397

[56] References Cited

UNITED STATES PATENTS

| | | | |
|---|---|---|---|
| 1,549,566 | 8/1925 | Bain | 137/418 X |
| 1,766,262 | 6/1930 | Simmons | 137/418 X |
| 1,902,049 | 3/1933 | True | 137/418 X |
| 2,234,088 | 3/1941 | Russel | 137/418 X |
| 2,590,473 | 3/1952 | Steins | 137/422 X |
| 2,606,543 | 8/1952 | Rappl | 137/418 X |
| 3,472,425 | 10/1969 | Booth | 137/411 X |

*Primary Examiner*—Alan Cohan
*Attorney, Agent, or Firm*—Isler and Ornstein

[57] ABSTRACT

A device for mixing gases with liquids is disclosed, which is characterized by the use of gas inlet and vent valves of unique construction and highly efficient in operation, and the use of a unique toggle mechanism for opening and closing said valves which consists of a minimum number of parts arranged to form a compact unit. The device further includes a fully enclosed or hollow float which coacts with the valve opening and closing mechanism, and a rigid metallic gas inlet tube which functions as a support for a gas diffuser.

2 Claims, 9 Drawing Figures

DEVICE FOR MIXING GASES WITH LIQUIDS

This invention relates, as indicated, to a device for mixing gases, such as carbon dioxide, with liquids, such as water, to produce carbonated water, but has reference more particularly to improvements in the device disclosed in the Buffington U.S. Pat. No. 3,746,323.

In Buffington U.S. Pat. No. 3,746,323, a device for mixing gases with liquid is disclosed, in which the device is fitted with a gas inlet port, a liquid inlet port, a liquid outlet port, and a tubular vent valve.

A pressurized source of water of sufficient pressure to operate the device is connected to the liquid inlet port, a source of compressed gas, such as carbon dioxide, is connected to the gas inlet port, and the liquid outlet port is connected to a faucet or other device for dispensing the gas-charged liquid produced by the device.

The tank which is to be filled with water contains a cup, and with the tank and cup empty, the vent valve is in closed position, due to the upward pull of springs which support the cup. When the operator turns on the water, it fills the cup, and the weight of the cup and water therein actuates a valve-operating yoke to cause a pinch valve plunger to close a pinch valve which pinches a flexible gas supply tube and opens the vent valve. During this action, the operator turns on a gas control valve which controls the flow of gas from the carbon dioxide cylinder to the gas inlet port.

The continued flow of water, after the cup has been filled, overflows the rim of the cup and fills the tank with water. As the water level in the tank rises above the water-filled cup, the latter gradually loses weight until it is no longer heavy enough to counteract the upward force exerted by the springs, and, as a result, the springs actuate a rod which causes the vent valve to close.

As the vent valve closes, the valve-operating yoke releases the pinching action of the pinch valve, permitting the carbon dioxide to pass through the flexible gas supply tube and through a diffuser, so that the gas streams upwardly through the water.

When the operator opens the faucet which is connected to the liquid outlet port, the gas pressure within the tank above the water in the tank forces the gas-charged liquid upwardly through the open end of a liquid discharge pipe to the place where it is being dispensed.

The consequent fall in the liquid level in the tank, after repeated withdrawals of the gas-charged liquid from the tank, causes the cup and the water within it to again fall, and the valve-operating yoke to again close the pinch valve and cut off the incoming gas flow while opening the vent valve to discharge the gas in the upper end of the tank while it is being refilled with water.

The device of the aforesaid Buffington patent has certain disadvantages or drawbacks, among which are the following:

a. The flexible gas supply tube, which is made of resilient material, such as resilient polyethylene synthetic plastic, tends to acquire a "set", due to repeated pinching thereof by the pinch valve plunger, so that the carrying efficiency of the tube is reduced, and the tube requires occasional replacement.

b. The flexible gas supply tube is utilized to support the diffuser thereby placing a strain on the tube, which strain is partially relieved by attaching the lower end of the tube to the lower end of the liquid discharge pipe.

c. The cup is suspended by extension coil springs which eventually acquire a permanent extension or set and adversely affect the operation of the device.

d. The mechanism for opening and closing the pinch valve and the vent valve requires excessive movement of certain parts thereof, such as the levers and springs employed in the mechanism, so that the device does not operate as quickly and efficiently as desired.

e. The device utilizes certain parts, such as coiled small bore flow-retarding tubing, which interfere with the operation of the device, and have been found unnecessary.

The present invention has, as its primary object, the provision of a device of the character described, which overcomes all of the aforesaid disadvantages or drawbacks of the device of the Buffington patent.

Another object of the invention is to provide a device of the character described, in which the use of flexible plastic tubing is eliminated, and the efficiency of gas supply to the device is greatly improved.

A further object of the invention is to provide a device of the character described, in which an improved mechanism for opening and closing the gas supply tube and vent valve is employed.

A further object of the invention is to provide a device of the character described, wherein the diffuser is wholly supported by a rigid gas supply tube, which is adequate for such support.

A still further object of the invention is to provide a device of the character described, wherein a closed float is utilized instead of the cup, to which reference has been made.

Other objects and advantages of my invention will be apparent during the course of the following description.

In the accompanying drawings forming a part of this specification, and in which like numerals are employed to designate like parts throughout the same, FIG. 1 is an elevational view of the device;

Figure 1:
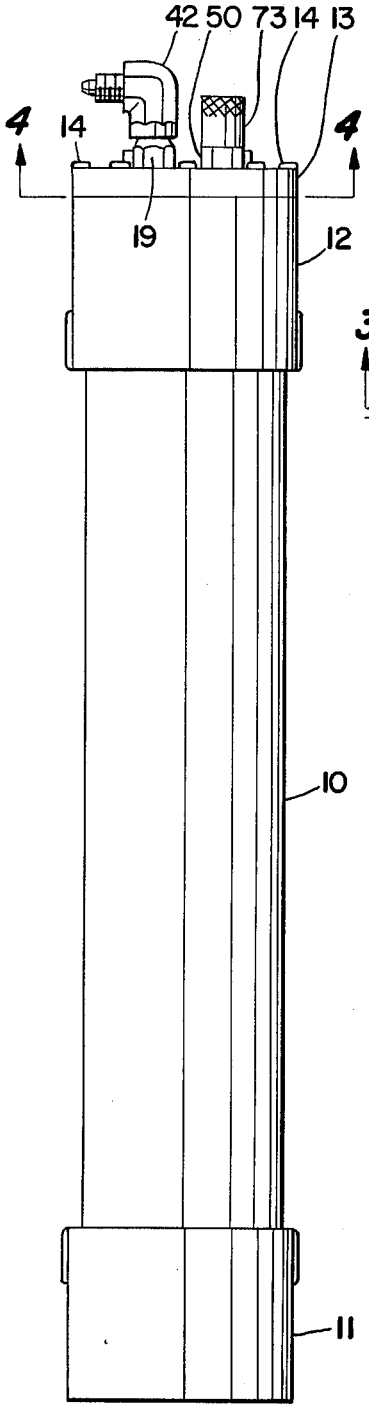
Figure 2:
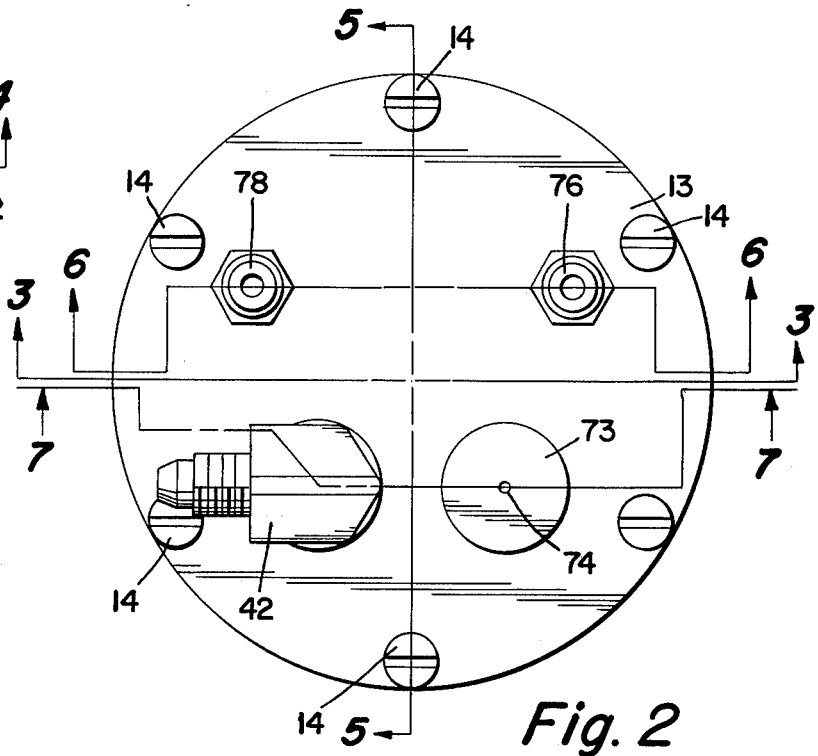
FIG. 2 is a top plan view, on an enlarged scale, of the device.

Referring more particularly to the drawings, the device will be seen to comprise an elongated cylindrical vessel or tank 10, closed at the bottom by a cap 11, and having secured to its upper end, a flanged member 12, to which a cover or cover plate 13 is secured, as by means of screws 14. The member 12 is provided with an annular recess 12*a*, adapted to receive an O-ring or similar seal 15, to provide a water-tight joint between the member 12 and cover plate 13.

The parts 10, 11 and 12 are preferably made of a light weight plastic, such, for example, as polyvinyl chloride, for lightness in weight and portability; while the cover plate 13 is also preferably made of polyvinyl chloride, or another plastic, such for example, as Plexiglas.

The device is so constructed that all of its operative components are attached to the cover plate 13 so as to be capable of being withdrawn as a self-contained unit from the tank 10.

The cover plate 13 is provided with a bore 16 (FIG. 7) which is counterbored, as at 16*a*, to receive a member 17, which is internally threaded, as at 18, for threaded engagement with a valve body 19, disposed in the bore 16, and which serves to clamp the member 17 to the lower face of the cover plate.

The member 17 is provided with an axial bore 20 in which a plunger 21 is slidably mounted, the plunger having a depending portion 21*a* of reduced diameter which extends through an axial bore 22 in the bottom of the member 17. An O-ring 23 is interposed between the wall of the bore 20 and the plunger 21, to prevent leakage of $CO_2$ through this bore.

The valve body 19 is provided with a bore 24 in its lower end, and with an annular flange 25 at the upper end of this bore, through which a passageway 26 extends.

Figure 8:
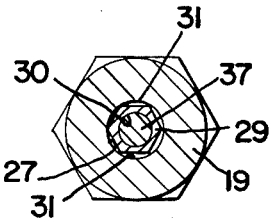
FIG. 8 is a cross-sectional view, taken on the line 8—8 of FIG. 7.

Above the flange 25, the valve body 19 is provided with an enlarged bore 27, the enlarged upper portion of which is threaded, as at 28. Disposed within the bore 27 is a valve guide element 29 having a cylindrical bore 30 extending axially therethrough, and having an external surface of hexagonal cross-section (see FIG. 8), the faces of the hexagon coacting with the wall of the bore 27 to provide passageways 31 for the flow therethrough of liquid carbon dioxide, as will be presently described.

The valve guide element 29 is maintained against the upper end of the flange 25 by a screw 32, which is secured to the threads 28 of the valve body 19, and is provided with an hexagonal socket 33, adapted to be engaged by an Allen wrench, when the screw 32 is to be removed from or inserted into the valve body. The socket 33 communicates with an axial passageway 34 in the screw 32, and this passageway is counterbored, as at 35, to provide a seat or ledge 35*a* for a purpose to be presently described.

The valve guide element 29 is also provided at its upper and lower ends with circumferentially-spaced radial passageways 36, those passageways 36 at the lower end establishing communication between the lower ends of the passageways 31 and the passageway 26, and those passageways 36 at the upper end establishing communication between the upper ends of the passageways 31 and the counterbore 35.

A valve 37 is provided, which is mounted for slidable movement in the cylindrical bore 30 of the valve guide element 29, and is provided with a stem 38 which extends through the passageway 26, but is of lesser diameter than this passageway. The valve 37 is provided at its juncture with the stem 38 with an O-ring 39, and the valve is normally maintained in closed position, that is to say, with said O-ring against the upper end of the flange 25 by a compression coil spring 40, which is interposed between the upper end of the valve 37 and the seat or ledge 35*a* of the screw.

The valve body 19 is externally threaded at its upper end, as at 41, for the connection thereto of a fitting 42, which is adapted to be connected to a supply line from a source of pressurized gas, such as $CO_2$.

The member 17 is provided with a radial extension 43, from which a fitting 44 depends, and to which a stainless steel tube 45 is secured, and extends downwardly into the tank 10.

The tube 45 is connected, as at 46, to a diffuser 47, which is described in Buffington U.S. Pat. No. 3,746,323, and which need not therefore be described in this application.

Carbon dioxide, which is admitted into the valve which has been described above, passes through a passageway 48 in the base of the member 17, through the extension 43, fitting 44, tube 45 and into the diffuser 47.

The cover plate 13 is drilled and threaded, as at 49 (see FIG. 7) to receive a fitting 50, which is part of a vent valve, the function of which will be described in the course of the description of the operation of the device.

The fitting 50 is threaded internally in its upper portion to receive a valve member 51, having an annular groove in its lower portion, in which is received an O-ring 53, which is in sealing engagement with the wall of an axial bore 54 in the fitting 50. The member 51 is maintained in adjusted position axially of the fitting 50 by means of a lock nut 55 secured to the upper end of the member 51 and which bears against the upper end of the fitting 50, when the member 51 is in such adjusted position.

The member 51 has a lower portion 56 of reduced diameter, which terminates in an annular valve seat 57.

A passageway 58 extends axially through the member 51, terminating at its upper end in a hexagonal socket 59, adapted to be engaged by an Allen wrench when the member 51 is to be adjusted axially of the fitting 50.

Figure 9:
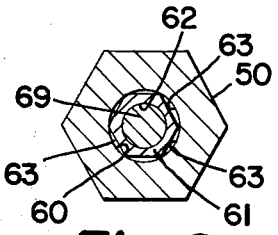
FIG. 9 is a cross-sectional view, taken on the line 9—9 of FIG. 7.

Below the valve seat 57, the member 51 has a bore 60 of slightly larger diameter than the bore 54, in which a valve guide element 61 is mounted, which is similar to the valve guide element 29. The valve guide element 61 has a cylindrical bore 62 extending axially therethrough, and has an external surface of hexagonal cross-section, the faces of the hexagon coacting with the wall of the bore 60 (see FIG. 9) to provide passageways 63 for the flow of vented gas therethrough, as will be presently described.

The valve guide element 61 is maintained against a shoulder 64 in the fitting 50 by means of a nut 65 which is threadedly secured in the lower end of the fitting 50, and has an axial bore 66, and slots 67 for enabling the nut to be rotated.

The valve guide element 61 is also provided at its upper and lower ends with circumferentially-spaced radial passageways 68, those passageways 68 at the lower end establishing communication between the bore 66 and the passageways 63, and those passageways 68 at the upper end establishing communication between the passageways 63 and the passageway 58 in the member 51.

The vent valve also includes a valve seating or closure element 69 which is slidable in the bore 62 of the valve guide element 61. The element 69 is provided at its upper end with a recess in which a Teflon seating disc 70 is secured, and has its lower end clinched or clamped to a ball 71 of a lever 72. The lever 72 is bifurcated at its lower end, for a purpose to be presently described.

The vent valve further includes a plastic cap 73, which is threadedly secured to the upper end of the fitting 50, and is provided with a small vent opening 74. The cap 73 has a knurled upper portion to facilitate rotation of the cap.

Figure 6:
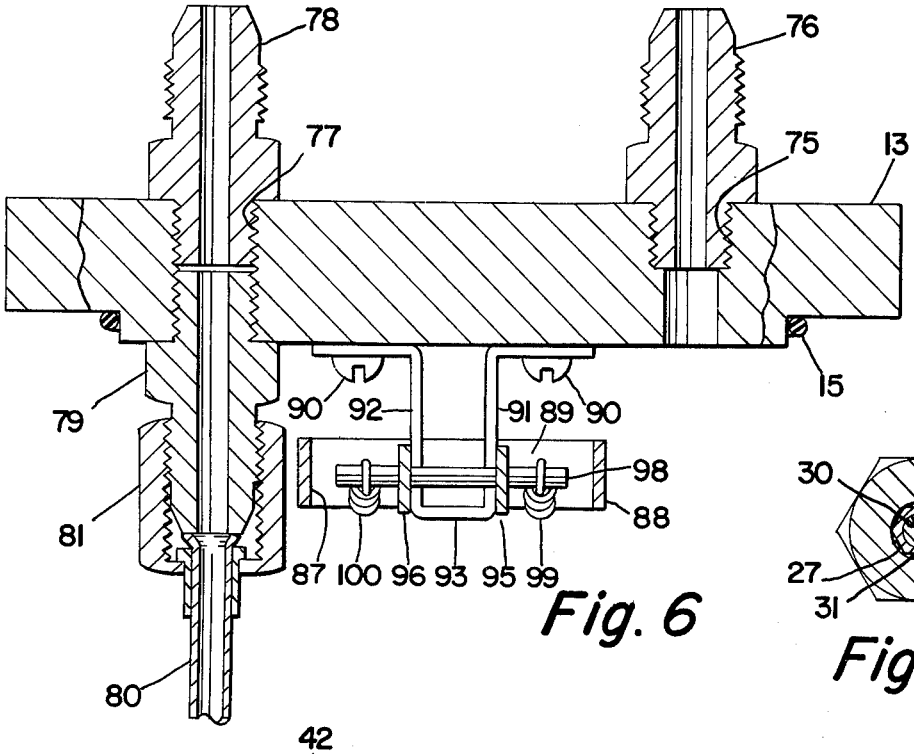
FIG. 6 is a cross-sectional view, taken on the line 6—6 of FIG. 2.

The cover plate is drilled and threaded as at 75 (FIG. 6) to receive a fitting 76 which is adapted to be connected to a pressurized source of water of sufficient pressure to operate the device.

The cover plate 13 is also drilled and threaded, as at 77 (FIG. 6), to receive a fitting 78, through which the carbonated water is dispensed through a valve or faucet (not shown). The threaded opening 77 receives, in its lower portion, a second fitting 79, to the lower end of which a stainless steel tube 80 is clamped, as by a nut 81. The tube 80 extends downwardly into the tank to a point closely adjacent the bottom of the tank (see FIG. 3).

Secured to the lower surface of the cover plate 13, as by screws 82, is a bracket 83 having spaced depending flanges 84 and 85, in the lower ends of which a pin or shaft 86 is mounted.

The shaft 86 has pivotally connected thereto the arms 87 and 88 of a U-shaped valve operating yoke, the body or base of which is designated by reference numeral 89.

Secured to the lower surface of the cover plate 13, in diametrically-spaced relation to the bracket 83, as by screws 90, is a second bracket of U-shaped conformation, having depending arms 91 and 92 interconnected at their lower ends by a web 93. The arms 91 and 92 have mounted therein a pivot pin or shaft 94, disposed in a common horizontal plane with the shaft 86.

The pin 94 has pivotally secured thereto the arms 95 and 96 of a second U-shaped valve operating yoke, the body or base of which is designated by reference numeral 97.

Figure 5:
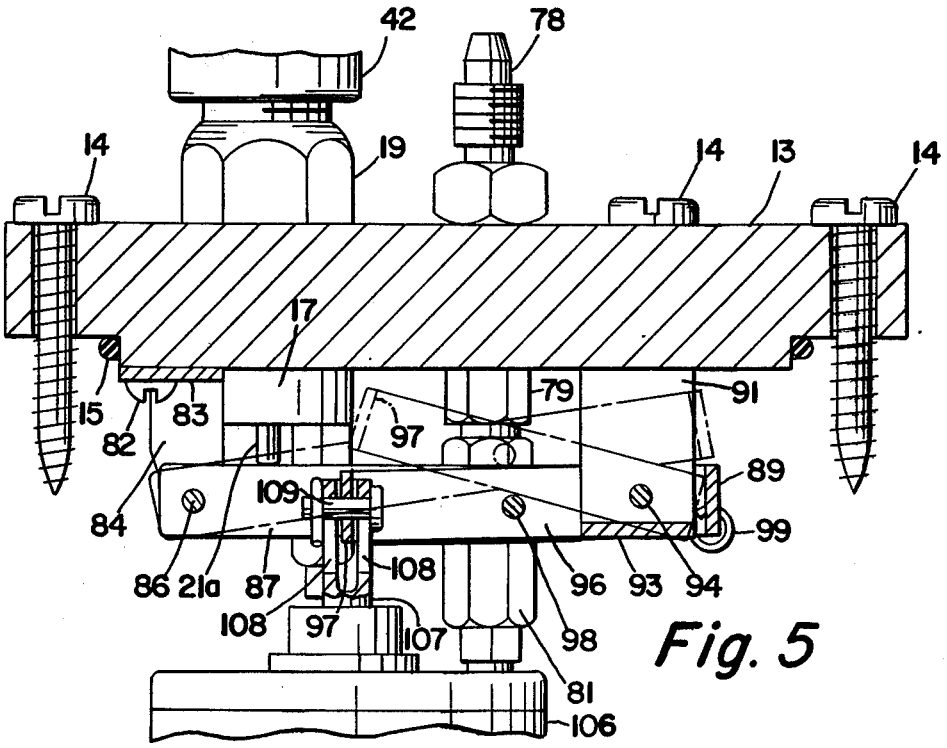
FIG. 5 is a cross-sectional view of the upper portion of the device, taken on the line 5—5 of FIG. 2.

The arms 95 and 96 have mounted therein, at substantially the mid-point of their lengths, a pin 98, the axis of which, as seen in FIG. 5, is normally slightly below a line passing through the axes of the pins 86 and 94. The yoke 95-96-97 is normally maintained in the position shown in solid lines in FIG. 5 by means of extension coil springs 99 and 100, one end of each of which is connected to the pin 98 and the other end of each of which is connected to the body or base 89 of the valve operating yoke 87-88-89.

Figure 4:
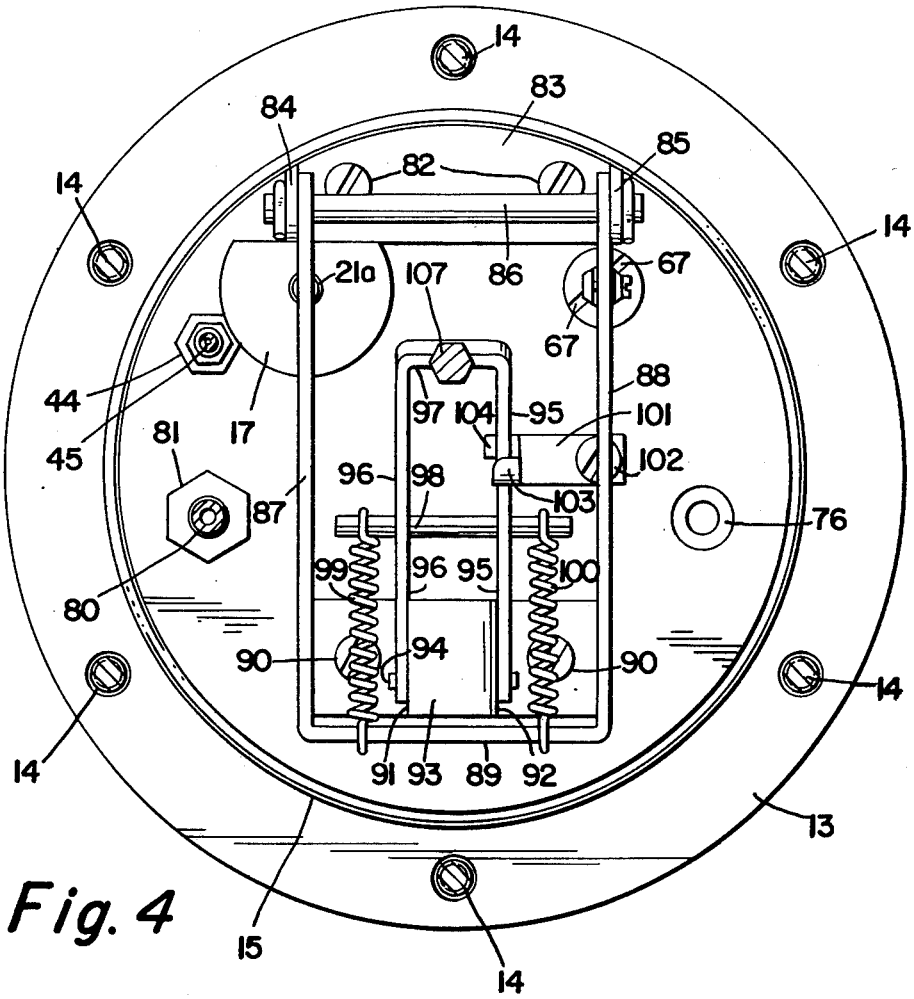
FIG. 4 is a plan view, on an enlarged scale, of the cover or cover plate, as viewed in the direction indicated by the arrows 4—4 in FIG. 1, and showing parts attached to the cover or cover plate.

The yokes 87-88-89 and 95-96-97 constitute parts of a toggle mechanism, of which the axis of the pin 98, when on a line passing through the axes of the pins 86 and 94, is the "dead center." In FIG. 5, this dead center is slightly below said line, but the pin 98 cannot move below this solid line position, due to the provision of a stop member 101 (FIGS. 4 and 7), which is secured to the cover plate 13 by a screw 102. The stop member 101 is provided with an inturned flange 103, against which the arm 95 of the yoke 95-96-97 abuts when the pin 98 is in the solid line position to which reference has been made. The stop member 102 is also provided with a second inturned flange 104 against which the arm 95 of the yoke 95-96-97 abuts when the yokes 95-96-97 and 87-88-89 are in the broken line position shown in FIG. 5, to thereby limit the upward movement of the toggle, as will be presently described.

Figure 7:
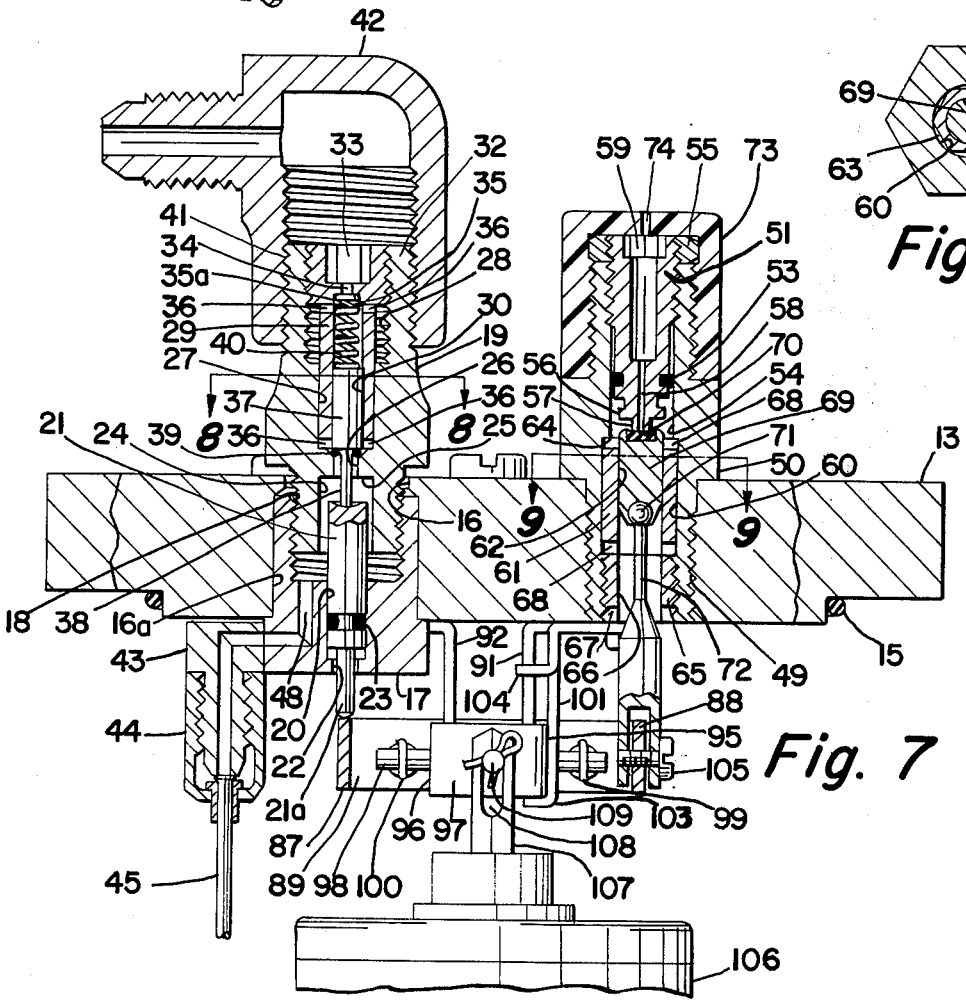
FIG. 7 is a cross-sectional view, taken on the line 7—7 of FIG. 2.

With the valve 37 closed, as seen in FIG. 7, the stem 21*a* of the plunger 21 rests on the arm 87 of the yoke 87-88-89.

The bifurcated lower end of the lever 72 is, as shown in FIG. 7, pivotally connected, as by a screw 105, to the arm 88 of the yoke 87-88-89.

The device further includes a hollow light weight float 106, preferably made of polyvinyl chloride, and weighing, in this instance, approximately 9 ounces. This float extends downwardly into the tank 10, and has secured to its upper end a post 107 having a bifurcated upper portion in which the body or base 97 of the yoke 95-96-97 is received. The furcations of the post 107 are, as shown in FIGS. 5 and 7, provided with elongated slots 108. A pin 109, is mounted in the body or base 97 of the yoke 95-96-97, and extends through the slots 108. A pin 109, is mounted in the body or base 97 of the yoke 95-96-97, and extends through the slots 108. The function of this connection will be explained in connection with the operation of the device.

In the operation of the device, it is assumed that the fitting 76 is connected to a pressurized source of water of sufficient pressure to operate the device, that the fitting 42 is connected to a source of compressed gas, such as carbon dioxide, and that the fitting 78 is connected to the faucet or other device for dispensing the gas charged liquid produced by the device.

Figure 3:
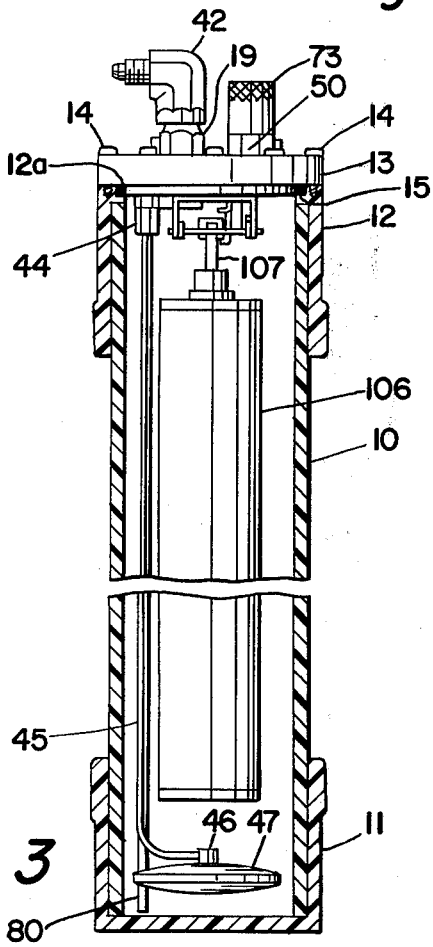
FIG. 3 is a cross-sectional view, taken on the line 3—3 of FIG. 2, but with the cover or cover plate in elevation.

At this time, the tank 10 is empty, the float 106 in its lowermost position as shown in FIGS. 3, 5 and 7, and the vent valve member 51 open, due to the action of the springs 99 and 100 on the yoke 87-88-89, causing the yoke to push the valve seating element downwardly. At the same time, the valve 37 is closed, due to the action of the spring 40.

When the operator turns on the water, it flows through the fitting 76 and into the tank 10, filling the tank with water. As the tank becomes filled, the float 106 will rise in the tank, and when the bottoms of the slots 108 in the post 107 come into engagement with the pin 109, the yoke 95-96-97 will rock upwardly about the pin 94 until the axis of the pin 98 has just passed the dead center position, to which reference has been made. At this point, the springs 99 and 100 cause the yokes 87-88-89 and 95-96-97 to snap upwardly to the position shown in broken lines in FIG. 5, causing the arm 87 of the yoke 87-88-89 to push the plunger 21 upwardly to thereby open the valve 37, permitting the carbon dioxide to pass downwardly through the valve and into the tube 45, from which the carbon dioxide passes through the diffuser and outwardly and upwardly through the water within the tank, thereby charging the water with the carbon dioxide.

When the water is thus fully charged with carbon dioxide, the space in the upper part of the tank above the gas charged water becomes filled with carbon dioxide, which exerts pressure on the gas charged water, so that the gas charged water may be released through the tube 80 and fitting 78 by opening the faucet or other device for dispensing the gas charged liquid.

When the water level in the tank 10 is lowered, due to discharge of the gas charged water through the fitting 78, the float 106 descends, due to its own weight, causing the upper ends of the slots 108 to engage the pin 109, and thereby returning the yokes to the position shown in solid lines in FIGS. 5 and 7. When this occurs, the vent valve is automatically opened, and the excess carbon dioxide in the space at the top of the tank is released into the atmosphere through the hole 74 in the cap 73, while, at the same time, the carbon dioxide valve is closed, due to the pressure of the spring 40, so that the entry of carbon dioxide into the tank is stopped. This permits the tank to be refilled with water.

The aforesaid operative steps may then be repeated as often as is necessary or desired.

By utilizing a rigid metallic or stainless steel tubing 45, instead of the flexible plastic tubing of the Buffington patent, the creation of a "set" in the tubing, due to repeated pinching thereof by the pinch valve plunger is avoided, the carrying efficiency of the tube is increased, and the tube never requires to be replaced.

At the same time, the steel tubing 45 provides an adequate and substantial support for the diffuser 47, and eliminates the strain placed on a plastic tubing used for this purpose.

The valves used in applicant's device, particularly the gas inlet valve and vent valves, are of unique construction and highly efficient in operation, requiring a minimum amount of movement of the parts thereof.

The toggle mechanism for opening and closing the gas inlet and vent valves, is also of unique construction, requiring a minimum number of parts, arranged in a compact unitary form, and highly efficient in its operation, particularly in speed of operation.

The use of the fully enclosed light-weight float is highly advantageous, in that it eliminates the possibility of foreign particles from the water being caught or held in the float, as is possible in the cup arrangement of the Buffington patent. Moreover, the manner in which the float is utilized in conjunction with the valve opening and closing mechanism makes for a more positive and direct coaction between these parts, than that achieved through the use of the suspension springs and rods of the Buffington patent, and insures an efficient operation of the present device.

It is to be understood that the form of my invention, herewith shown and described, is to be taken as a preferred example of the same, and that various changes may be made in the shape, size and arrangement of parts thereof, without departing from the spirit of the invention or the scope of the subjoined claims.

Having thus described my invention, I claim:

1. In a device of the character described, a closed-bottom tank for containing a liquid, a cover plate for said tank removably secured to said tank, means mounted on said plate for admitting liquid into said tank, a normally-closed valve unit mounted on said plate for admitting a gas under pressure through said valve unit and into said tank for charging said liquid with said gas, a second normally-open valve unit mounted on said plate for venting excess gas from the upper end of said tank into the atmosphere, means mounted on said cover plate for dispensing the gas charged liquid from said tank, a completely enclosed float disposed in said tank, said float movable upwardly in the tank in response to filling of the tank with said liquid, means for simultaneously opening said first valve unit and closing said second valve unit in response to said upward movement of said float, said last-named means comprising a shaft supported by said plate, a first member of U-shaped configuration having arms pivotally connected to said shaft, a pin supported by said plate, a second member of U-shaped configuration having arms extending in a direction opposite to that of the arms of said first member and pivotally connected to said pin, a second pin extending through the arms of said second member and parallel with said shaft and first pin, and extension coil springs interconnecting said second pin with the base of said first-named member, and means interconnecting said float with the base of said second member, said first valve unit including a plunger supported by one of the arms of said first member, and said second valve unit including a lever pivotally connected to the other arm of said first member.

2. A device, as defined in claim 1, wherein said float is provided at its upper end with an upstanding post, and means are provided for pivotally interconnecting said post with the base of said second member.

* * * * *